US005975719A

United States Patent [19]

Reiff et al.

[11] Patent Number: 5,975,719

[45] Date of Patent: Nov. 2, 1999

[54] FLUORESCENT WORK LIGHT COVER AND ROTATABLE SOCKET

[75] Inventors: Paul J. Reiff; David L. Reiff, both of Bluffton, Ind.

[73] Assignee: General Manufacturing, Inc., Bluffton, Ind.

[21] Appl. No.: 08/931,644

[22] Filed: Sep. 16, 1997

[51] Int. Cl.[6] ..... F21K 27/00

[52] U.S. Cl. ..... 362/260; 362/223; 362/399

[58] Field of Search ..... 362/260, 223, 362/221, 222, 399, 226

[56] References Cited

U.S. PATENT DOCUMENTS

| | | | |
|---|---|---|---|
| D. 149,448 | 4/1948 | Schwartz et al. | D48/4 |
| D. 164,507 | 9/1951 | McCann | D48/4 |
| 1,932,143 | 10/1933 | Piercy | 240/52.1 |
| 2,225,825 | 12/1940 | Desimone | 240/10.6 |
| 2,228,680 | 1/1941 | Tornblom | 240/54 |
| 2,244,736 | 6/1941 | Stewart | 240/73 |
| 2,347,174 | 4/1944 | Cross et al. | 240/11.4 |
| 2,760,053 | 8/1956 | Choisser | 240/11.4 |
| 3,383,675 | 5/1968 | Allardice et al. | 340/321 |
| 3,805,053 | 4/1974 | Julinot | 240/51.11 |
| 4,247,884 | 1/1981 | McJunkin, Jr. et al. | 362/164 |
| 4,249,234 | 2/1981 | Park et al. | 362/228 |
| 4,262,327 | 4/1981 | Kovacik et al. | 362/223 |
| 4,303,967 | 12/1981 | Letsche | 362/119 |
| 4,432,043 | 2/1984 | Yuen | 362/184 |
| 4,521,837 | 6/1985 | Bouchard | 362/216 |
| 4,564,890 | 1/1986 | Poyer | 362/216 |
| 4,658,337 | 4/1987 | Burke | 362/225 |
| 4,672,515 | 6/1987 | Baker | 362/398 |
| 4,692,848 | 9/1987 | Poyer | 362/216 |
| 4,787,018 | 11/1988 | Poyer | 362/216 |
| 4,878,159 | 10/1989 | Blaisdell et al. | 362/22 |
| 4,885,670 | 12/1989 | Baake | 362/400 |
| 4,897,768 | 1/1990 | Thul | 362/191 |
| 4,945,461 | 7/1990 | Crates | 362/378 |
| 4,958,267 | 9/1990 | Baake | 362/399 |
| 5,117,345 | 5/1992 | Baake | 362/390 |
| 5,170,332 | 12/1992 | Browne | 362/376 |
| 5,203,624 | 4/1993 | Schier et al. | 362/158 |
| 5,301,093 | 4/1994 | Baggio | 362/260 |
| 5,436,815 | 7/1995 | Grooms et al. | 362/260 |
| 5,528,477 | 6/1996 | Carmo | 362/260 |
| 5,564,821 | 10/1996 | Hesprich | 362/399 |
| 5,765,941 | 6/1998 | Vest | 362/260 |

*Primary Examiner*—Nimeshkumar D. Patel
*Assistant Examiner*—Todd Reed Hopper
*Attorney, Agent, or Firm*—Baker & Daniels

[57] ABSTRACT

A fluorescent work light having a cover with restraining elements for restricting the movement of the fluorescent lamp. The restraining elements are inwardly projecting integral portions of the cover and restrict the lateral, rotational and axial movement of the fluorescent lamp. The work light also includes a rotatable socket with permits the cover to be threadingly engaged to the handle while rotationally engaging the fluorescent lamp. The distal end of the cover may consist entirely of transparent material to thereby permit light to be emitted from the distal end of the cover in all outward directions.

34 Claims, 11 Drawing Sheets

FLUORESCENT WORK LIGHT COVER AND ROTATABLE SOCKET

BACKGROUND OF THE INVENTION

1. Field of the Invention

The present invention relates to fluorescent work lights.

2. Description of the Related Art

Fluorescent work lights which are relatively compact and portable and may thus be used to light a task or inspection area are well known. Conventional fluorescent work lights often include a handle component for gripping the light, a compact fluorescent lamp for providing illumination and a cover surrounding the lamp which is at least partially transparent. A conventional electrical cord having a plug for connection to an electrical outlet is used to connect the work light to a source of electrical current. A ballast, or "choke", is typically utilized to provide the proper voltage and current for the fluorescent lamp and may be placed in the handle or in a separate unit disposed along the cord at or near the plug.

The covers typically take the form of a generally tubular body having one open end attachable to the handle and an open distal end ("distal" being used to refer to the end opposite the handle) which is closed by an end piece. The end piece can be secured to the tubular body by adhesives, welding, threading, a spindle with screw and nut, and other means. A significant portion of the tubular body is usually transparent to thereby permit the light generated by the fluorescent lamp to be transmitted through the cover. Although the end pieces, or end caps, are most often opaque, it is also known to utilize covers having end pieces which permit at least some light to be transmitted through the end piece. The end pieces may also be formed as a lens to focus the light.

The fluorescent lamp disposed within the cover, although relatively compact, has a generally elongate shape. The projecting end of the lamp is often restrained within the cover by an insert, such as an O-ring or cushion, to prevent the lamp from being subjected to excessive inadvertent movement within the cover and the damage which can result therefrom.

SUMMARY OF THE INVENTION

The present invention provides an improved fluorescent work light having a unitary, transparent cover with an integral distal end portion and integral indentations for securing the fluorescent lamp within the cover.

The invention comprises, in one form thereof, a fluorescent work light and a transparent cover having integral restraining elements. The generally tubular transparent cover has an open proximate end and a closed distal end and integral indentations proximate each of the two ends. The distal end portion is formed integrally with the cover. The indentations form restraining elements and are adapted to cooperate with a fluorescent lamp and inhibit the movement of the lamp within the cover. The restraining elements may be adapted to inhibit not only the lateral movement of the lamp, i.e., the radially inward and outward movement of the lamp, but may also axially and rotationally engage the base of the lamp.

An advantage of the present invention is that the integral distal end portion simplifies the manufacture of the cover. Since the distal end is formed integrally with the cover, there is no need for separate manufacturing steps involving the manufacture and attachment of an end cap to the cover.

An advantage of the present invention is that the integral restraining elements formed in the cover inhibit the movement of the lamp within the cover and thereby reduce the amount of lamp damage and breakage which can occur when the work light is impacted or subject to movement.

Another advantage of the present invention is that the use of integral restraining elements eliminates the need to provide discrete inserts for securing the fluorescent lamp within the cover. The integral restraining elements can be formed during the manufacture of the cover and are thus relatively inexpensive to manufacture. The use of integral restraining elements also reduces the number of parts which must be handled during assembly of the work light and thereby reduces the cost of assembling the work light. The use of a cover having integral restraining elements also permits the lamp to be more easily and safely removed and replaced by the consumer/user of the work light than work lights having separate restraining elements which must be removed from the burnt out or broken lamp and placed upon the replacement lamp. Furthermore, integral restraining elements are not subject to misplacement and loss when the lamp is replaced by the user of the light.

Another advantage is that the cover of the present invention does not require the removal of any screws or pins in order to gain access to the lamp. Thus, no tools are required to replace the lamp.

Another advantage is that the work light of the present invention may include a rotatable socket which permits the fluorescent lamp to be rotated during the attachment of the cover to the handle. This allows restraining elements to prevent relative rotation between the fluorescent lamp and a cover which is threadingly engaged to the handle thereby permitting the restraining elements to more effectively restrain the lamp within the cover. The rotatable socket also facilitates the easy and convenient replacement of fluorescent lamps.

Yet another advantage is that the cover may have a distal end section which consists entirely of transparent material. The transparent distal end of the cover thereby permits light to be transmitted in all directions from the distal end of cover which can be particularly useful when illuminating small and irregularly-shaped spaces and enclosures.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
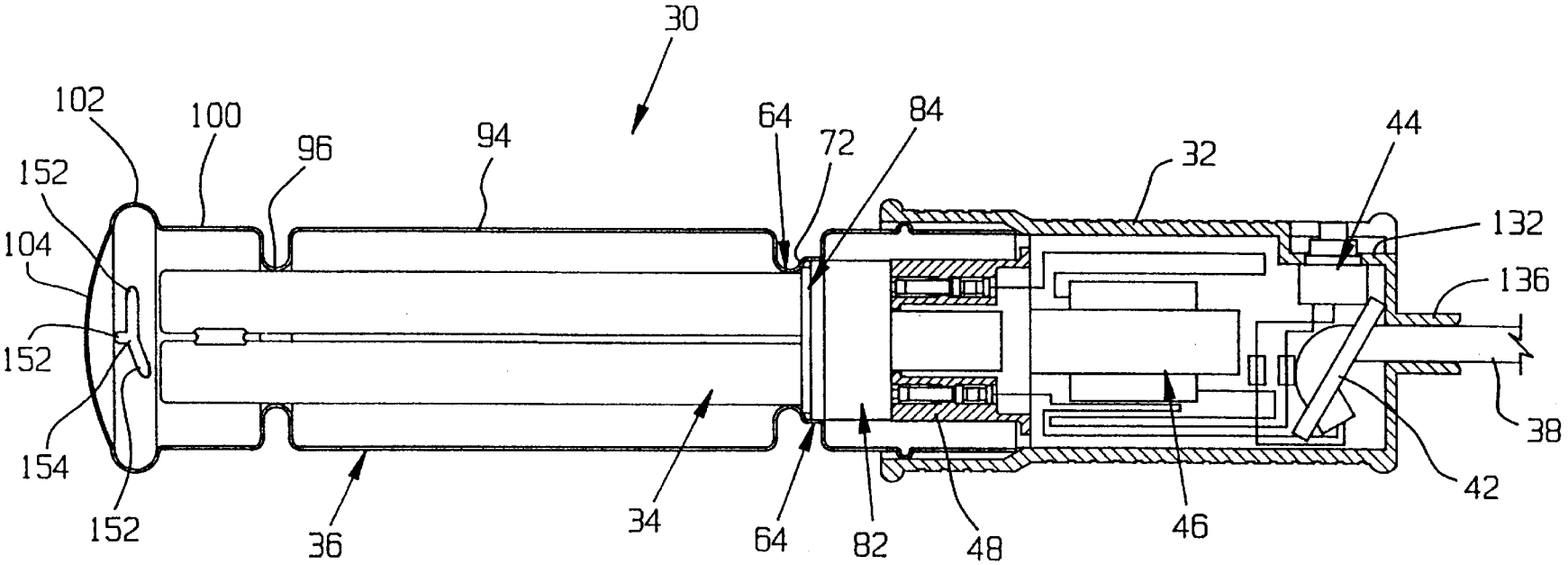
FIG. 1 is a schematic cross sectional view of a fluorescent work light embodying the present invention.
Figure 2:
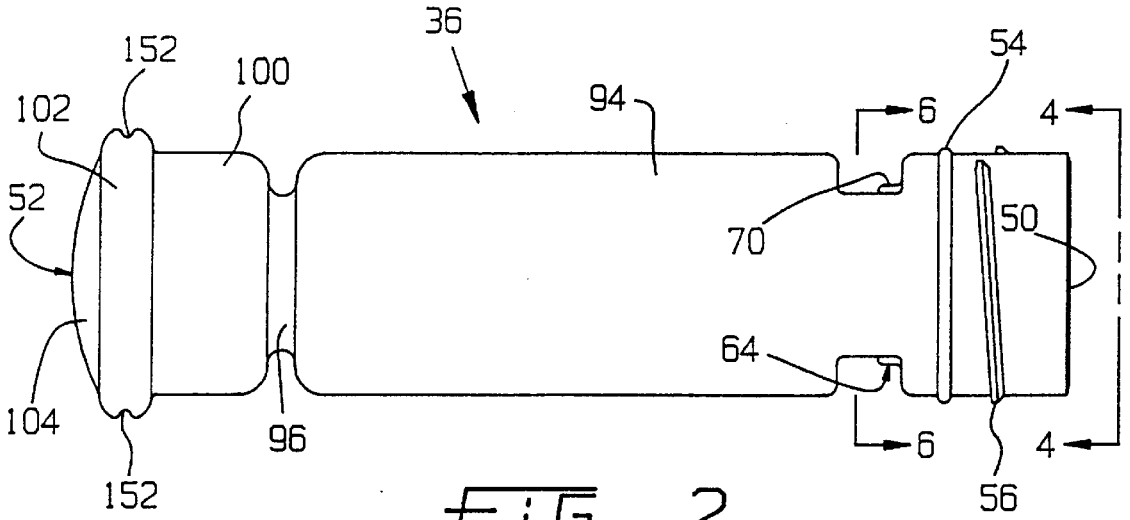
FIG. 2 is a front elevational view of the cover.
Figure 3:
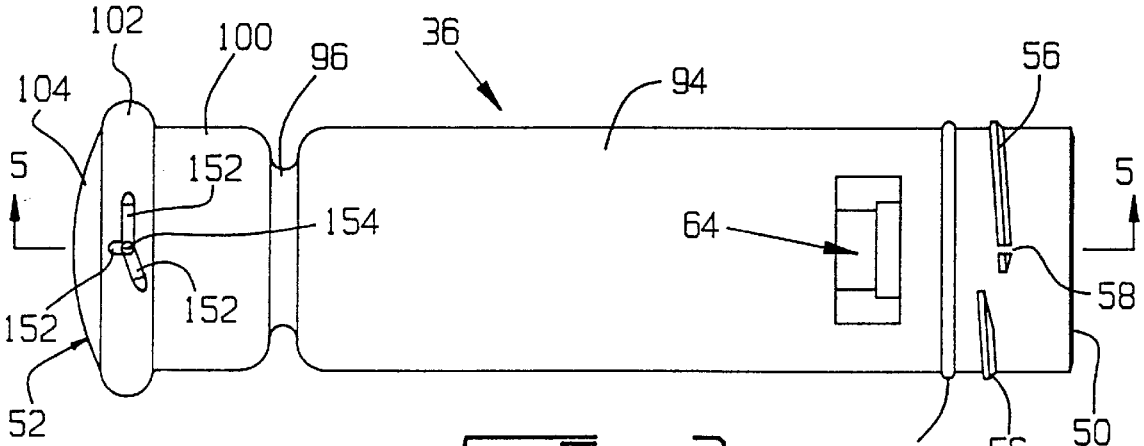
FIG. 3 is a side view of the cover.

Corresponding reference characters indicate corresponding parts throughout the several views. Designation of top and elevational views of the individual parts does not imply any particular spatial orientation between the separately depicted parts as assembled. Although the drawings represent an embodiment of the present invention, the drawings are not necessarily to scale and certain features may be exaggerated. The embodiment disclosed below is an illustration of the invention but is not intended to be exhaustive or limit the scope of the invention to the precise form disclosed in the following detailed description.

DESCRIPTION OF THE PRESENT INVENTION

Referring now to the drawings and particularly to FIG. 1, there is shown a highly schematic cross section of a work light 30. Work light 30 includes a handle 32, a fluorescent lamp 34 and a cover 36.

Figure 28:
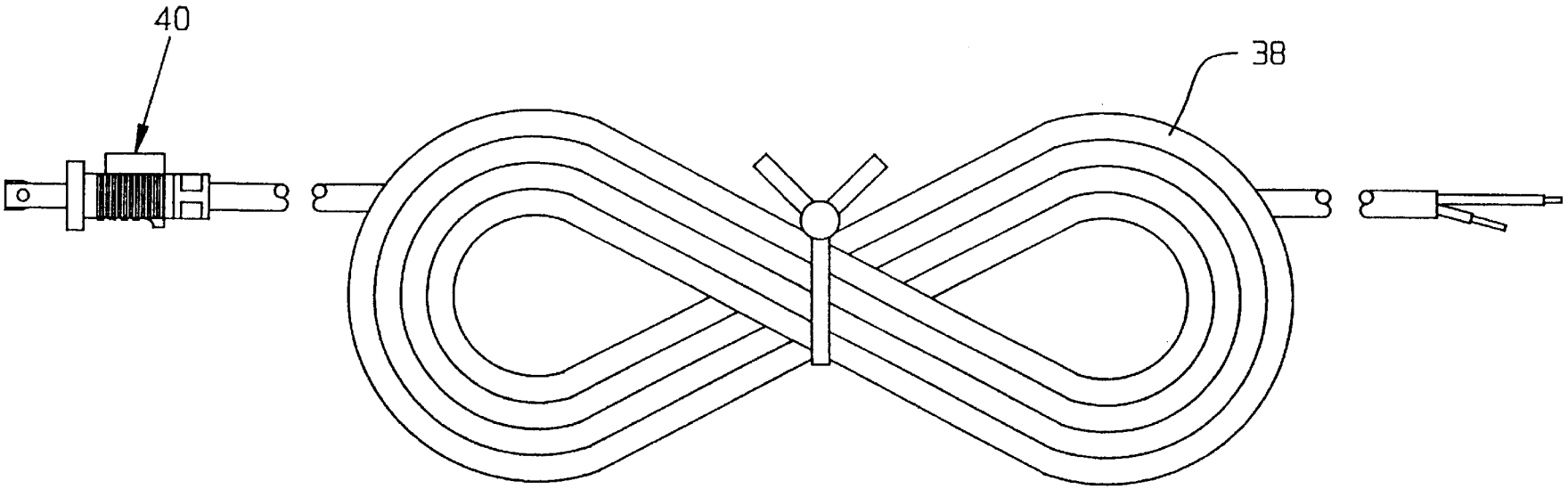
FIG. 28 is a view of the cord.

Extending from handle 32 is a power cord 38 which provides power for lamp 34. As can be seen in FIG. 28, power cord 38 is a conventional power cord having a plug 40 for connecting with an electrical outlet (not shown) at one end. The end of power cord 38 opposite plug 40 is threaded through a conventional strain relief mechanism 42 disposed within handle 32. Strain relief mechanism 42 prevents the electrical wiring and connections within handle 32 from being subjected to tension which may be present in cord 38 between strain relief mechanism 42 and plug 40.

A conventional switch 44 and ballast 46, well known in the art, are also housed in handle 32. Also provided in handle 32 is a rotatable socket 48 as further described hereinafter. Fluorescent lamp 34 is plugged into socket 48. Power cord 38, switch 44, ballast 46 and socket 48 are electrically connected in a conventional manner whereby lamp 34 may be selectively actuated by switch 44 when plug 40 is inserted into an electrical outlet. Alternatively, switch 44 may be omitted from the work light and lamp 34 may be selectively actuated by inserting and removing plug 40 from an electrical outlet.

Figure 13:
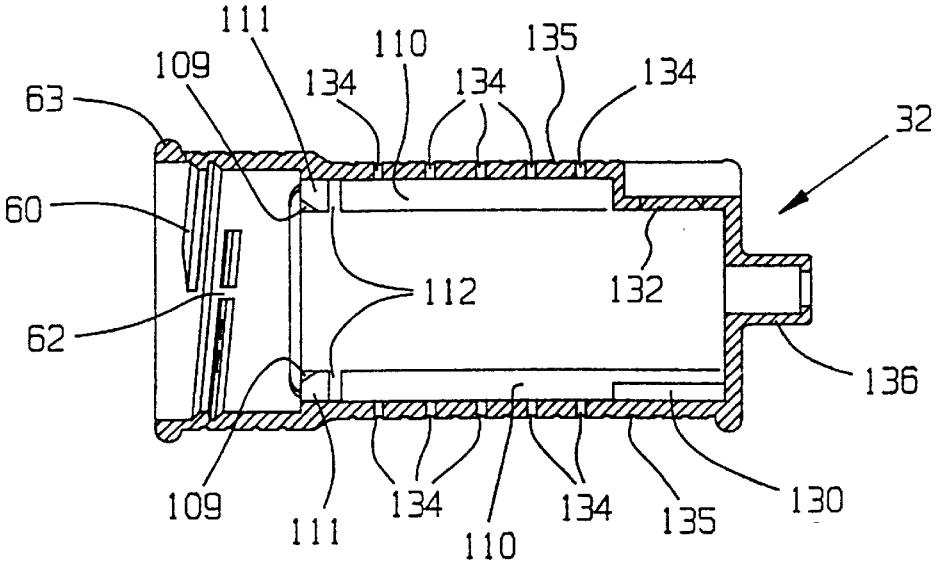
FIG. 13 is cross sectional view of the handle taken along line 13—13 of FIG. 9.
Figure 14:
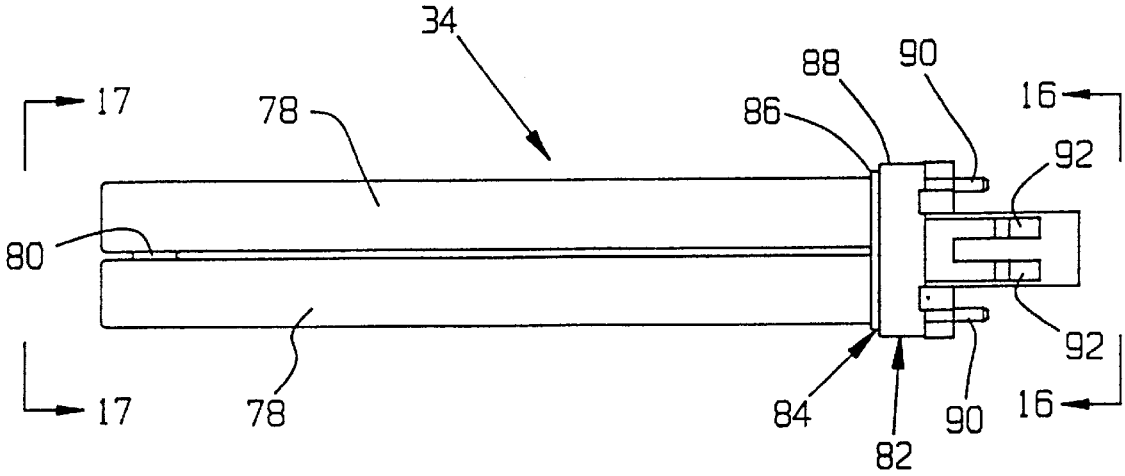
FIG. 14 is a front elevational view of the fluorescent lamp.
Figure 15:
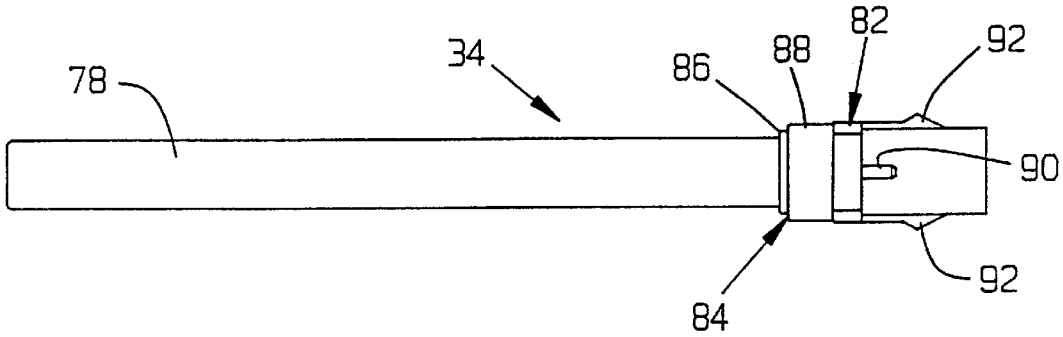
FIG. 15 is a side view of the fluorescent lamp.
Figure 16:
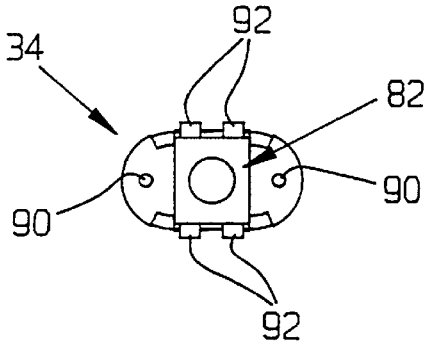
FIG. 16 is an end view of the fluorescent lamp taken along line 16—16 of FIG. 14.
Figure 17:
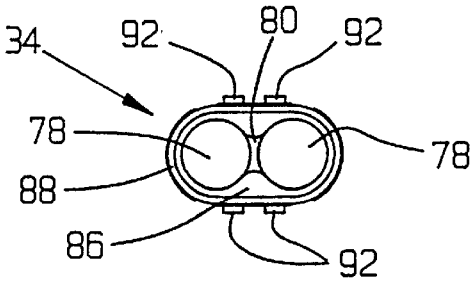
FIG. 17 is an end view of the fluorescent lamp taken along line 17—17 of FIG. 14.

Cover 36 is a unitary member which may be formed of clear plastic material. Cover 36 is blow molded as a unitary member but may also be manufactured using other methods such as vacuum form or injection molding and is shown in detail in FIGS. 2–6. The illustrative embodiment discussed herein is formed of a single transparent plastic material. Polycarbonate is used to form the illustrated embodiment, however, many different plastic materials may also be used to form the cover. It is also possible to form a unitary plastic component such as cover 36 from two or more differing types of plastic, and cover 36 could also be formed as a unitary member having both transparent and opaque portions. Cover 36 threadingly engages handle 32 at an open end 50 located opposite a closed distal end 52. Near proximal open end 50, cover 36 includes a projecting collar 54 and threading 56. Threading 56 includes a small gap 58 near the beginning of each spiral thread. Threading 56 mates with spiral grooves 60 located in handle 32 and which are shown in FIG. 13. Grooves 60 may include a small projection 62 near one end which mates with small gap 58 when cover 36 has been threadingly engaged with handle 32. Gap 58 and projection 62 help to maintain cover in position once it has been threadingly engaged with handle 32, however, gap 58 and projection 62 can be omitted in alternative embodiments. When cover 36 has been threadingly engaged with the handle 32, collar 54 is disposed radially inwardly of rib 63 within handle 32 and helps stabilize cover 36 relative to handle 32.

Also near open end 50 are a pair of locking indentations 64 or proximal restraining elements. Locking indentations 64 are formed integrally with cover 36 and include sidewall 66, an inner arcuate wall 68, an intermediate arcuate wall 70, an inner shoulder 72 which is disposed between the two arcuate walls, an intermediate shoulder 74, and an upper wall 76. Locking indentations 64 are adapted to engage and secure fluorescent lamp 34.

Conventional fluorescent lamp 34 includes a pair of cylindrically shaped glass elements 78 interconnected by a bridge 80, which form the light emitting portion of lamp 34 and which are mounted on a base 82. Although the illustrated embodiment utilizes a twin tube lamp, alternative embodiments of the present invention may be used with differently configured lamps which, for example, may have three or four tubes. Fluorescent lamp 34 is readily available from sources such as Philips Lighting Company, 200 Franklin Square Drive, P.O. Box 6800, Somerset, N.J. 08875. Base 82 includes a stepped shoulder 84 with an upper shoulder 86 and a lower shoulder 88, a pair of projecting terminals 90 and four wedge-shaped projections 92. Base 82 can be plugged into a socket 48 whereby terminals 90 are connected to a source of electrical current and lamp 34 may be supported within work light 30. Wedge-shaped projections 92 can be used to secure lamp 34 within a socket. In the illustrated embodiment, however, wedge-shaped projections 92 are unnecessary and lamp 34 is secured to socket 48 by proximal restraining elements 64.

Figure 4:
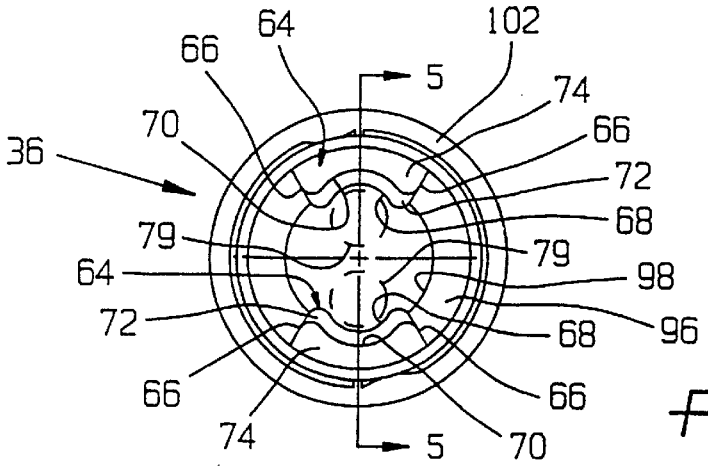
FIG. 4 is an end view of the cover taken along line 4—4 of FIG. 2.
Figure 5:
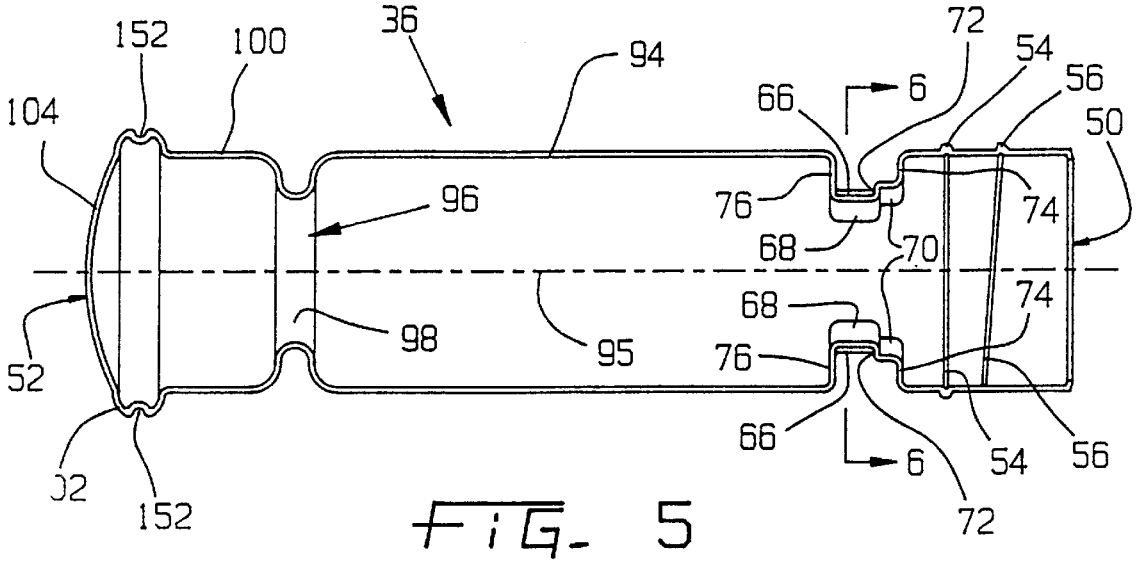
FIG. 5 is a cross sectional view of the cover taken along line 5—5 of FIGS. 3 and 4.
Figure 6:
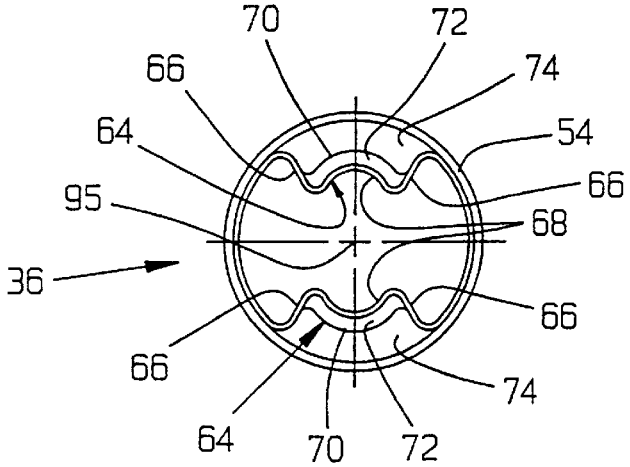
FIG. 6 is a cross sectional view of the cover taken along line 6—6 of FIGS. 2 and 5.

When lamp 34 is inserted into cover 36, most conveniently after engagement of lamp 34 and socket 48, each glass cylinder 78 is located adjacent one of the substantially U-shaped inner arcuate walls 68 as represented by dashed outlines 79 in FIG. 4. In a similar manner, the two arcuate outer edges of stepped shoulder 84 are located adjacent substantially U-shaped arcuate walls 70 which are intermediate inner arcuate walls 68 and elongate cylindrical wall section 94. Inner shoulder 72 of cover 36 engages the stepped shoulder 84 of lamp 34 as can be seen in FIG. 1 when lamp 34 is inserted completely within cover 36. As cover 36 is rotated to threadingly engage cover 36 with handle 32, arcuate walls 68 and 70 rotationally engage lamp 34 and cause lamp 34, as well as socket 48 which is engaged with lamp 34, to rotate along with cover 36 about cover axis 95 which also corresponds to the axis of handle 32. As cover 36 threadingly engages handle 32, inner shoulder surface 72 axially biases base 82 into engagement with socket 48. As discussed in greater detail below, socket 48 includes an outwardly projecting flange 106 which is rotatably engaged by handle 32 and thereby permits socket 48 to rotate with lamp 34 as cover 36 is threadingly engaged to handle 32.

After cover 36 has been secured to handle 32, arcuate walls 68, 70 and inner shoulders 72 act as restraining surfaces which restrict the movement of lamp 34 within cover 36. Arcuate walls 68, 70 are disposed laterally adjacent glass cylinders 78 and stepped shoulder 84 respectively and restrict the rotational and lateral movement of lamp 34 within cover 36. (Lateral is used to refer to a direction transverse to the longitudinal axis of cover 36.) Although arcuate walls 68, 70 are not necessarily always in direct contact with lamp 34, upon a slight rotational or lateral movement of lamp 34, lamp 34 will engage arcuate walls 68, 70 which will thereby restrict the further movement of lamp 34 within cover 36. As described above, inner shoulders 72 engage base 82 and directly restrict the longitudinal axial movement of lamp 34. By axially securing lamp 34 to socket 48, inner shoulders 72 also tend to limit the amount of lateral movement experienced by lamp 34.

Cover 36 also includes an integral distal restraining element 96 having a restraining surface 98 located near distal end 52. Distal restraining element 96 is an inwardly projecting portion of cover 36 which defines an annular element with its radially inward facing restraining surface 98. Distal restraining element 96 has an interior diameter equal to, or slightly larger than, the largest width of the glass cylinder portion of lamp 34. As can be seen in FIG. 1, the distal end of lamp 34 is inserted through the circular opening formed by distal restraining element 96 and the lateral movement of lamp 34 is restrained by restraining surface 98. With reference to FIG. 4, it can be seen that restraining surface 98 inhibits the lateral movement of lamp 34 parallel to line 5—5 of FIG. 4 after relatively little or no lateral movement of lamp 34 parallel to line 5—5. Lateral movement transverse to line 5—5 is also restricted by restraining surface 98 but a slightly greater amount of movement in this transverse direction can occur before lamp 34 contacts restraining surface 98.

Although distal restraining element 96 is illustrated as an inward annular projection which encircles the entire outer circumference of cover 36, U-shaped inward projections similar to proximal restraining surfaces 68 could be used as distal restraining elements. It would also be possible to utilize an inward annular projection as a proximal restraining element or utilize differently configured integral restraining elements which included restraining surfaces for inhibiting the movement of lamp 34 within cover 36 or use more or less of the restraining elements than are shown in the illustrated embodiment.

A significant advantage of the integral restraining elements is that they are molded or formed integrally with the cover. By forming the restraining elements integrally with the cover, the manufacture of the cover is simplified by eliminating the need to separate manufacture restraining inserts and insert them into the cover. The use of integral restraining elements also prevents the restraining elements from becoming separated from the cover during the useful life of the cover.

Located between the proximal restraining elements 64 and distal restraining element 96 is elongate section 94 which, together with the rest of cover 36 defines an interior space and axis 95 of cover 36. Cover 36 consists entirely of a transparent material and, when the generally elongate light generating portion of lamp 34 is actuated, the light produced by lamp 34 is transmitted from the interior space of cover 36 to outside cover 36. It is possible to line a portion of elongate section 94 with a reflective material 156 to direct a larger percentage of the generated light in a particular direction. In addition to its light directing function, the reflective backing material can also be used to convey warnings regarding the use of work light 30, display trademarks or convey other information.

A distal end section of cover 36 is located distally of restraining element 96 and elongate section 94. The distal end section defines the terminal end of cover 36 and is located proximate the distal end of lamp 34. The distal end section includes a short tubular section 100, a projecting rim or bumper 102, and a distal end cap 104, all of which are integrally formed with cover 36 and consist entirely of transparent material. Distal end cap 104 defines a portion of a sphere and, together with the remainder of the transparent distal end section, permits light generated by lamp 34 to be transmitted in all outward directions from the distal end of cover 36. By permitting light to be transmitted in all outward directions from the distal end of cover 36, work light 30 can be used to illuminate small and irregular spaces which are difficult to adequately illuminate using a directional light source.

Figure 18:
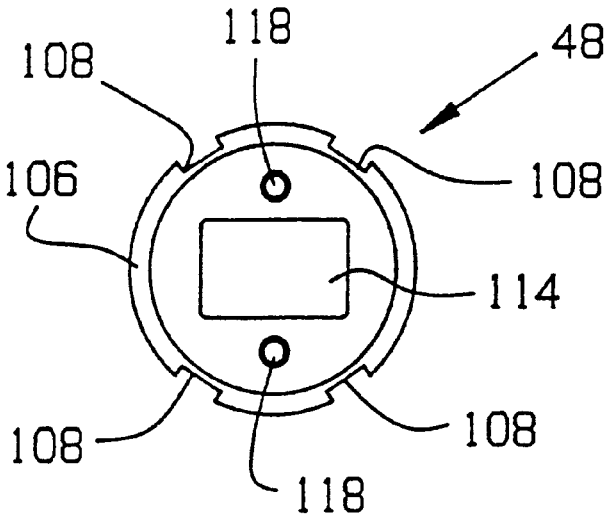
FIG. 18 is a top end view of the socket.
Figure 19:
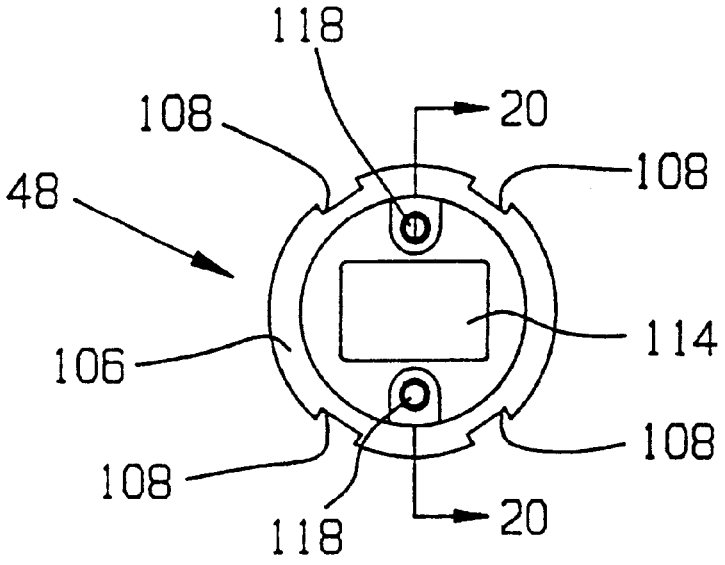
FIG. 19 a bottom end view of the socket.
Figure 20:
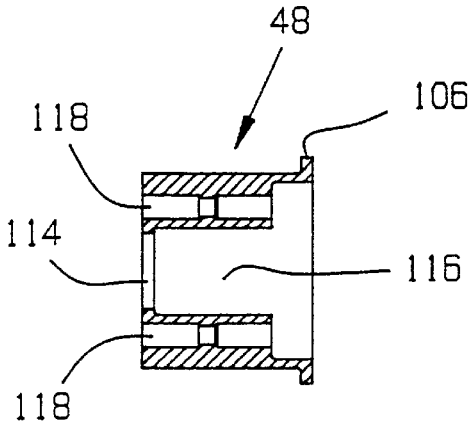
FIG. 20 is a cross sectional view of the socket taken along line 20—20 of FIG. 19.

Socket 48 supports lamp 34 and is rotatably supported in handle 32 and is illustrated in FIGS. 18–20. Socket 48 is generally cylindrical and has an outwardly projecting flange 106 at one end. Flange 106 includes four notches 108 which correspond to four ribs 110 located in handle 32. As can be seen in FIG. 13, ribs 110 each include a groove 112 into which flange 106 is rotatably received. Flange 106 is installed into handle 32 by aligning notches 108 with upper portions 111 of ribs 110, axially sliding upper rib portions 111 along notches 108 until flange 106 is in the same axial plane as grooves 112 and then rotating socket 48 whereby flange 106 will be rotatably supported within grooves 112. Lead-in ramps 109 are located on the upper surface of upper rib portions 111 and facilitate the alignment and assembly of socket 48 and handle 32.

Socket 48 includes a central aperture 114 on the end of socket 48 opposite flange 106. Socket 48 is positioned in handle 32 such that aperture 114 is directed outward, facing the open end of handle 32. Aperture 114 receives the center extending portion of base 82 when lamp 34 is engaged with socket 48. The central interior space 116 of socket 48 does not engage wedge-shaped projections 92 of lamp 34. However, means for engaging projections 92 to thereby axially secure lamp 34 to socket 48 could be included in alternative embodiments.

Figure 29:
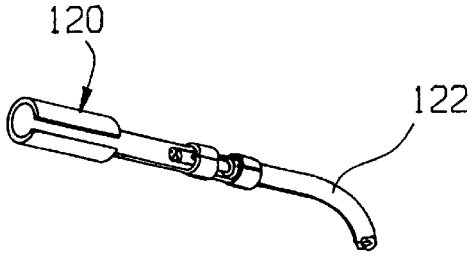
FIG. 29 is a perspective view of a terminal receptacle and connecting wire.

Socket 48 also includes terminal apertures 118. Located within terminal apertures 118 are electrical connectors 120, shown in FIG. 29, for receiving and providing electrical communication with terminals 90. Connectors 120 are attached to wiring 122 having a sufficient length to permit rotation of socket 48.

Figure 24:
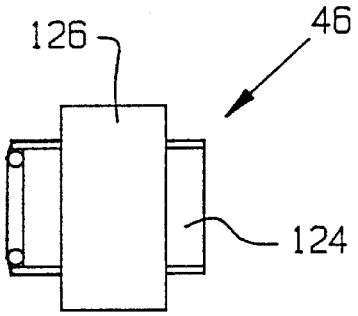
FIG. 24 is a top view of the ballast.
Figure 23:
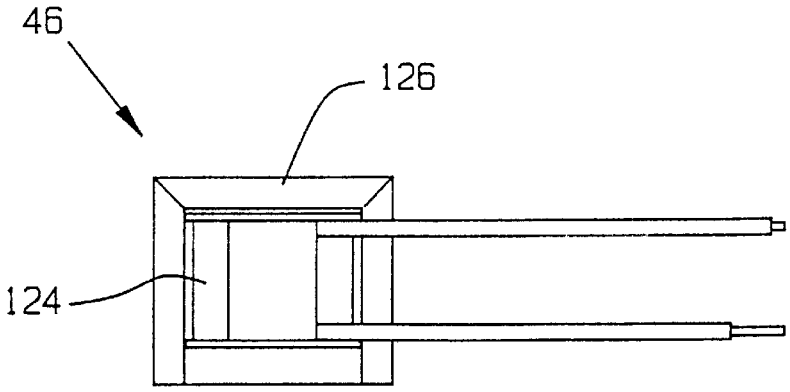
FIG. 23 is a front elevational view of the ballast.

Handle 32 supports both cover 36 and socket 48 and houses additional electrical components including ballast 46 and switch 44. Ballast 46, schematically illustrated in FIGS. 23 and 24, includes windings 124 and laminated metal sheets which define an outer rectangular portion 126. The outer rectangular portion 126 of ballast 46 is insertable into channel 128 defined by ribs 110 in handle 32. When inserted into channel 128, ballast 46 can only be moved in an axial direction. After final assembly of work light 30, axial movement of ballast 46 is restricted in one direction by posts 130 and switch housing enclosure 132 and in the other axial direction by socket 48. Handle 32 also includes vent holes 134 to allow heat to escape from the interior of handle 32. A sleeve 136 is located at one end of handle 32 and cord 38 is routed therethrough. Handle 32 also includes indentations 135 on its outside surface to provide an easily grippable surface.

Figure 7:
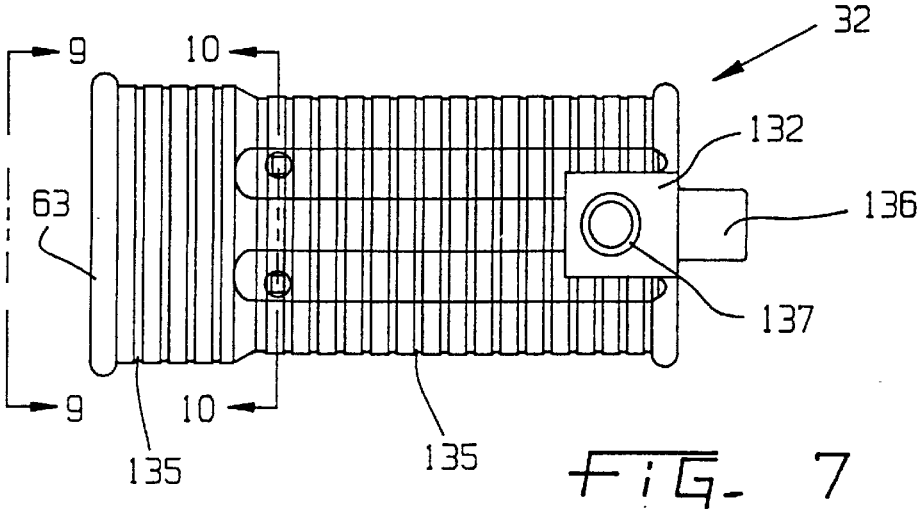
FIG. 7 is a front elevational view of the handle.
Figure 8:
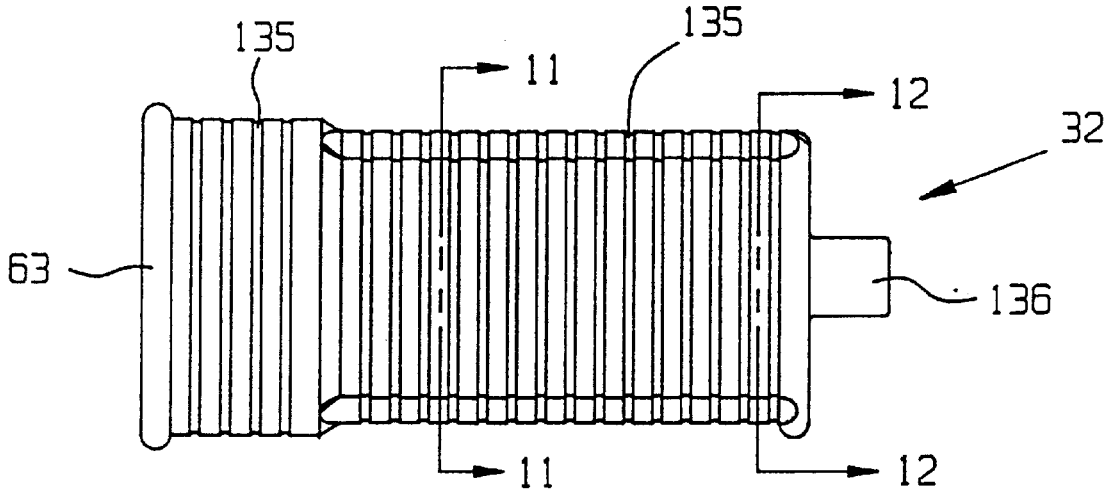
FIG. 8 is a side view of the handle.
Figure 9:
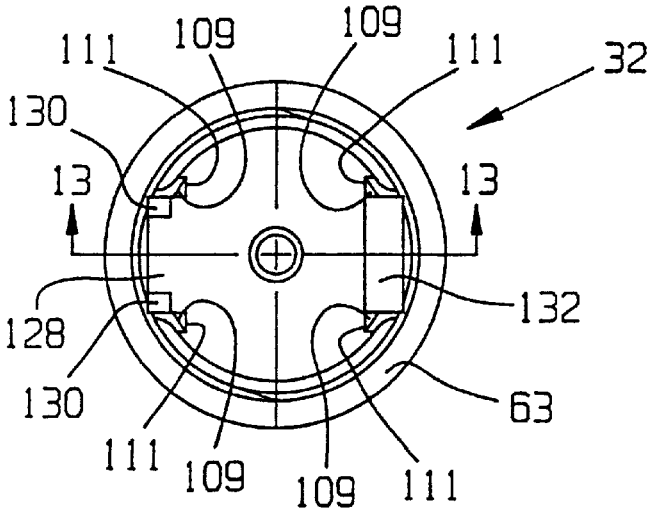
FIG. 9 is an end view of the handle taken along line 9—9 of FIG. 7.
Figure 10:
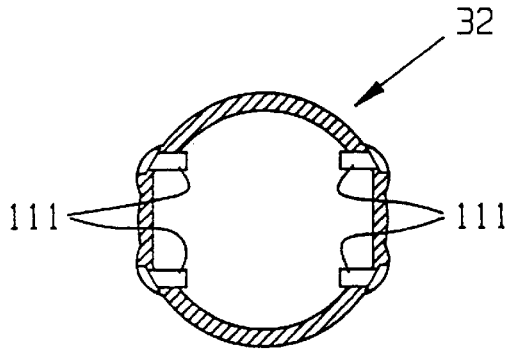
FIG. 10 is a cross sectional view of the handle taken along line 10—10 of FIG. 7.
Figure 11:
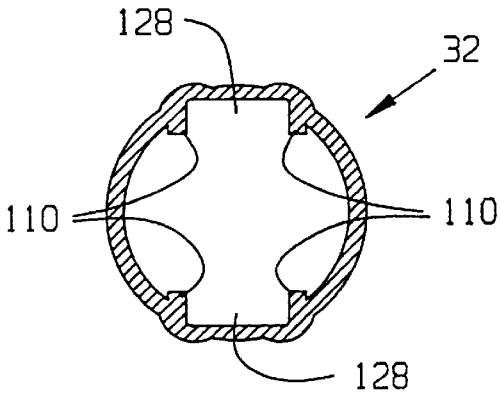
FIG. 11 is a cross sectional view of the handle taken along line 11—11 of FIG. 8.
Figure 12:
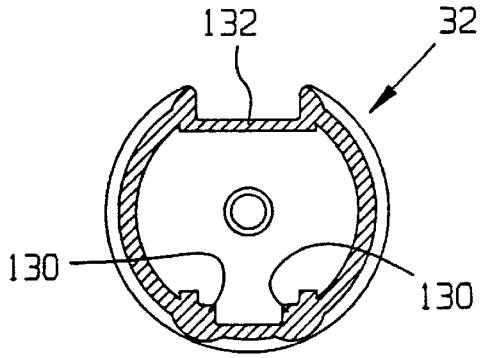
FIG. 12 is a cross sectional view of the handle taken along line 12—12 of FIG. 8.
Figure 25:
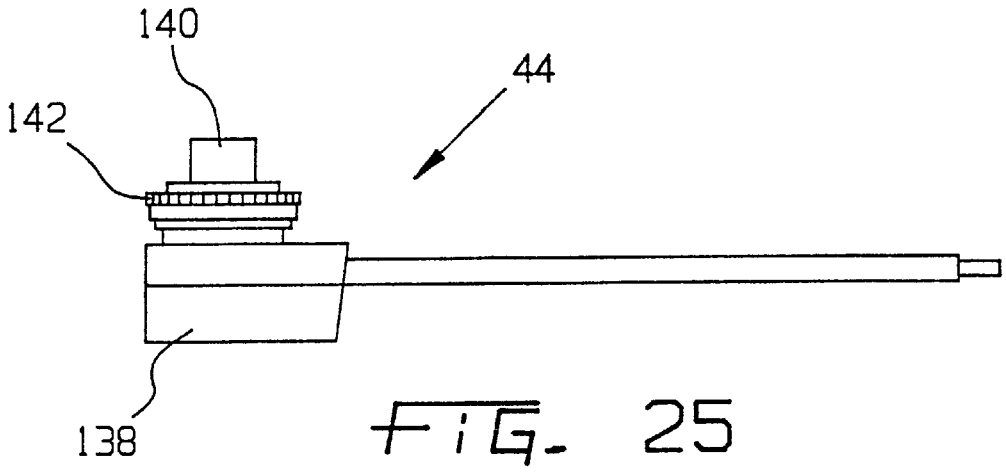
FIG. 25 is a side view of the switch.
Figure 26:
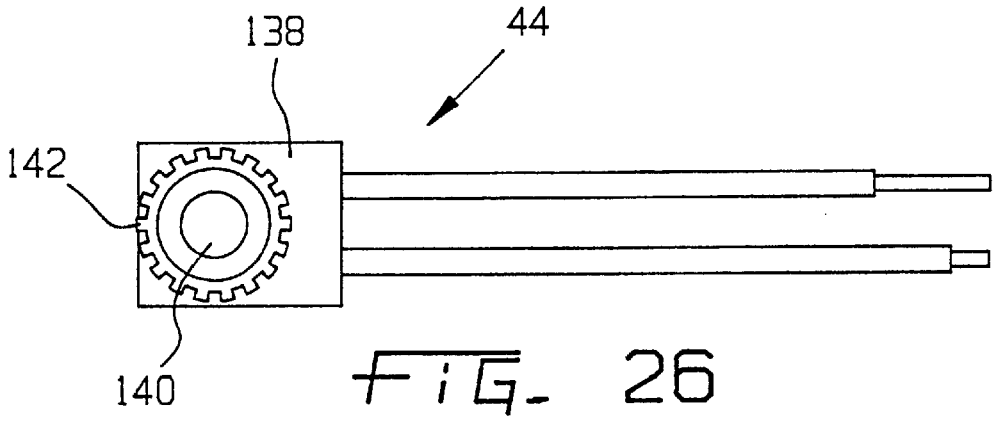
FIG. 26 is a top view of the switch.
Figure 27:
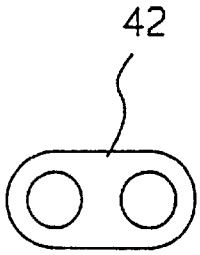
FIG. 27 is a top view of the strain relief mechanism.

Switch assembly 44 is a conventional switch provided in the electrical circuit of work light 30 as schematically illustrated in FIG. 1. Switch assembly 44 includes a switch housing 138, a button 140 and a detachable threaded collar 142 (FIGS. 25, 26). Switch assembly 44 is not essential to the functioning of work light 30 but does provide a mechanism for turning the light "on" and "off" which is more convenient than inserting and removing plug 40 from an electrical outlet. Switch housing enclosure 132 of handle 32 includes a round aperture through which button 140 may extend outward. As can be seen in FIG. 7, an annular groove 137 is formed in handle 32 and provides a convenient means for punching a round aperture in switch housing enclosure 132 of handle 32. After punching a round aperture in switch housing enclosure 132, button 140 can be extended outward through the aperture and threaded collar 142 attached to switch assembly 44 from the outside of handle 32 to thereby secure switch assembly 44 in place.

Figure 21:
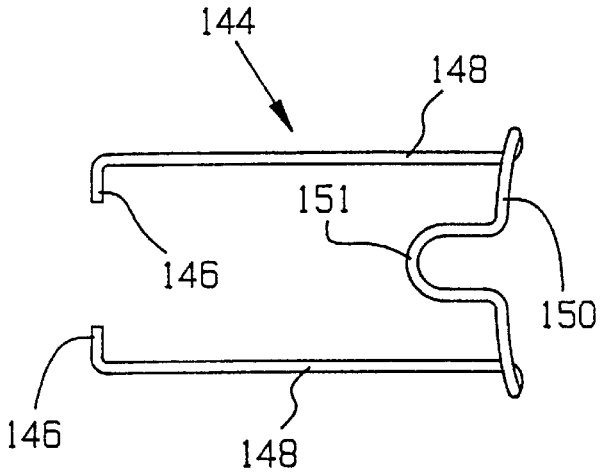
FIG. 21 is a front elevational view of the bail hook.
Figure 22:
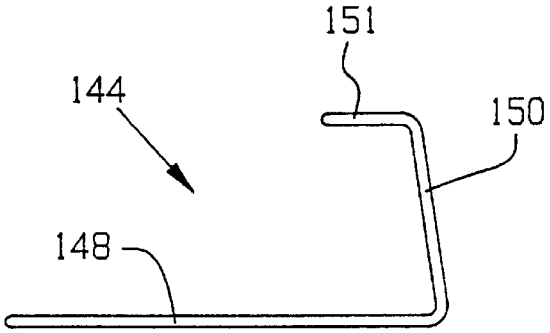
FIG. 22 is a side view of the bail hook.

Work light 30 also includes a bail hook 144 which is shown in FIGS. 21 and 22. Bail hook 144 includes inwardly projecting pivot arms 146, elongate arms 148, and an opposite generally circular portion 150 with tab 151. Pivot arms 146 are inserted through cover 36 at small depressions in projecting rim 102. Two small depressions are located opposite one another on rim 102 and include three detent portions 152 and a center portion 154. Pivot arms 146 pierce cover 36 at center portion 154 to pivotally attach bail hook 144 to cover 36. Detents 152, formed integrally in cover 36, can be used to maintain elongate arms 148 in the predetermined positions defined by the detents.

Figure 30:
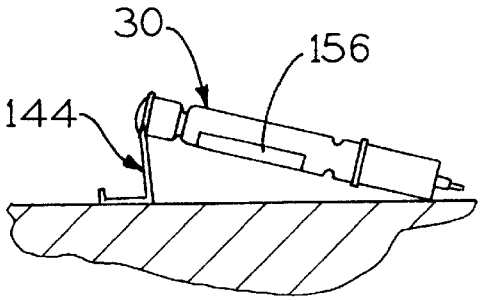
FIG. 30 is a side view of a work light set upon a horizontal surface.
Figure 32:
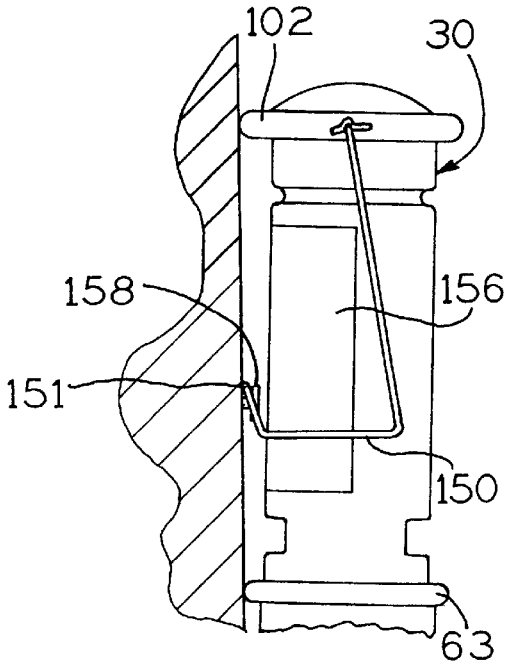
FIG. 32 is a side view of a work light suspended from a fastener.
Figure 31:
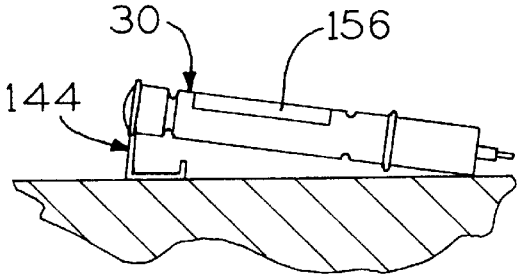
FIG. 31 is a side view of a work light set upon a horizontal surface.

As schematically illustrated in FIGS. 30–32, bail hook 144 can be used to suspend or support work light 30. In FIG. 30, bail hook 144 is held in a first predetermined position by detents 152 and reflective material 156 directs light in a generally upwards direction when work light 30 is placed on a horizontal surface. In FIG. 31, bail hook 144 is held in a second predetermined position by detents 152 and reflective material 156 directs light in a generally downwards direction when work light 30 is placed upon a horizontal surface.

The generally circular portion 150 of bail hook 144 can engage the outer surface of elongate section 94 when the use of bail hook 144 is not required to prevent bail hook 144 from becoming unintentionally entangled with other objects. As shown in FIG. 32, it is also possible to suspend work light 30 when circular portion 150 is engaged with elongate section 94 by engaging a fastener 158, or similar projection, with tab 151. Bail hook 144 may also be held in a third predetermined position (not illustrated) by detents 152 in which bail hook 144 extends in a direction generally opposite to the direction illustrated in FIG. 32. Bail hook 144 may also be used to suspend work light 30 in this third predetermined position.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A fluorescent work light comprising:

a fluorescent lamp having a base adapted to receive electrical current and a generally elongate light generating portion extending from said base;

a handle;

a socket supported by said handle, said socket electrically connectable to said base, said base mountable on said socket;

a unitary one piece cover supported by said handle, said cover having an open end disposed proximate said handle and a closed distal end disposed opposite said open end, said closed distal end integrally formed with said cover, said cover having an elongate section disposed between said open and distal ends, said elongate section defining an interior space, at least a portion of said light generating portion of said lamp disposed within said interior space, at least a portion of said cover comprising a light transmissive material whereby light is transmittable from said interior space to outside of said cover.

2. The fluorescent work light of claim 1 wherein said distal closed end and a distal section of said cover adjacent said distal closed end consists essentially of a transparent material.

3. The fluorescent work light of claim 1 wherein said unitary cover consists essentially of a transparent material.

4. The fluorescent work light of claim 1 wherein said unitary cover is a blow-molded cover.

5. The fluorescent work light of claim 1 further comprising a restraining element integrally formed and of one piece with said cover, said restraining element restricting movement of said lamp relative to said cover in at least one of an axial, a rotational and a lateral direction.

6. The fluorescent work light of claim 1 further comprising a restraining element restricting rotational movement of said lamp relative to said cover and wherein said socket is rotatable relative to said handle.

7. A fluorescent work light comprising:

a fluorescent lamp having a base adapted to receive electrical current and a generally elongate light generating portion extending from said base;

a handle;

a socket supported by said handle, said socket electrically connectable to said base, said base mountable on said socket;

a cover supported by said handle, said cover having an elongate section defining an interior space, at least a portion of said light generating portion of said lamp disposed within said interior space, said cover comprising a light transmissive material whereby light is transmittable from said interior space to outside of said cover; and a restraining element integrally formed and of one piece with said cover, said restraining element restricting movement of said lamp relative to said cover in at least one of an axial, a rotational and a lateral direction.

8. The work light of claim 7 wherein said restraining element is an inwardly projecting integral portion of said cover.

9. The work light of claim 7 wherein said cover further comprises a second restraining element integrally formed and of one piece with said cover for restricting movement of said lamp relative to said cover in at least one of an axial, a rotational and a lateral direction.

10. The work light of claim 7 wherein said cover is supported by said handle at a proximate end and said cover has an opposite distal end, said cover having a distal end section extending distally from a point proximate a distal end of said lamp and terminating in a distal end cap integrally formed and of one piece with said cover, said distal end section consisting essentially of transparent material.

11. The work light of claim 7 wherein said cover is supported by said handle at an open proximate end and said cover has an opposite, closed, distal end, said restraining element comprising an inwardly projecting integral portion of one piece with said cover disposed near said distal end of said cover, said restraining element having a restraining surface which restricts lateral movement of said lamp within said interior space.

12. The work light of claim 11 wherein said restraining surface encircles said lamp and is disposed on an annular inwardly projecting integral portion of said cover.

13. The work light of claim 11 wherein said cover extending distally of said restraining element consists essentially of a transparent material.

14. The work light of claim 11 further comprising a second restraining element disposed near said proximate end of said cover and comprising a second inwardly projecting integral portion of one piece with said cover, said second restraining element having a second restraining surface restricting movement of said lamp relative to said cover in at least one of an axial, a rotational and a lateral direction.

15. The work light of claim 14 wherein said second restraining surface restricts lateral movement of said lamp within said interior space.

16. The work light of claim 14 wherein said second restraining surface axially biases said base into engagement with said socket.

17. The work light of claim 7 wherein said cover is supported by said handle at a proximate end and has an opposite distal end, said restraining element comprising an inwardly projecting integral portion of one piece with said cover disposed near said proximate end, said restraining element biasing said base into engagement with said socket.

18. The work light of claim 17 further comprising a second restraining element disposed near said distal end of said cover opposite said restraining element and comprising a second inwardly projecting integral portion of said cover, said restraining elements each comprising a substantially U-shaped restraining surface rotationally engaging said lamp and a shoulder surface axially biasing said base into engagement with said socket, said socket rotatable relative to said handle.

19. The work light of claim 17 wherein said cover further comprises a second restraining element disposed near said distal end and comprising a second inwardly projecting integral portion of one piece with said cover, said second restraining element having a restraining surface which restricts lateral movement of said lamp within said interior space.

20. The work light of claim 7 wherein said lamp is rotationally engageable with said cover, said cover threadingly engageable with said handle and said socket rotatable relative to said handle.

21. The work light of claim 20 wherein said restraining element rotationally engages said lamp.

22. A fluorescent work light comprising:

a fluorescent lamp having a base adapted to receive electrical current and a generally elongate light generating portion extending from said base;

a handle;

a socket supported by said handle and rotatable relative to said handle about a longitudinal axis of said handle, said socket electrically connectable to said base, said base non-rotatably mountable on said socket;

a cover engageable with said handle, said cover being rotatable relative to said handle about said axis, said cover having an elongate axially extending section defining an interior space, at least a portion of said light generating portion of said lamp disposed within said interior space, at least a portion of said cover composed of a light transmissive material whereby light is transmittable from said interior space to outside of said cover; and a restraining element secured to said cover and rotationally engaging said lamp and restricting relative rotation of said lamp and said cover.

23. The work light of claim 22 wherein said cover is threadingly engageable with said handle.

24. The work light of claim 22 further comprising wiring electrically circuited to said socket, said wiring connecting said socket to an electrical component disposed within said handle, said electrical component rotationally fixed relative to said handle, said wiring having a length permitting relative rotation of said socket and said electrical component.

25. The work light of claim 22 wherein said cover has an open proximate end and an opposite, closed, distal end, said cover being supported by said handle at said proximate end, said cover having a distal end section extending distally from a point proximate a distal end of said lamp and terminating in a distal end cap integrally formed with said cover, said distal end section consisting essentially of transparent material.

26. The work light of claim 22 wherein said socket further comprises a radially outwardly projecting flange and said handle includes a groove, said flange rotatably disposed within said groove whereby said socket is rotatably supported within said handle.

27. The work light of claim 26 wherein said handle further comprises at least four axially extending ribs, said ribs each defining a portion of said groove.

28. The work light of claim 27 wherein said flange comprises a plurality of slots, said slots alignable with said ribs whereby said ribs are axially slidable within said slots.

29. The work light of claim 27 further comprising a ballast and wherein said plurality of ribs define a channel within said handle, said ballast disposed within said channel whereby said ribs prevent non-axial movement of said ballast.

30. A fluorescent work light comprising:

a fluorescent lamp having a base portion adapted to receive electrical current and a generally elongate light generating portion extending from said base portion;

a handle;

a socket disposed within said handle, said base portion being mountable on said socket and electrically connectable with said socket;

a cover having an open proximate end, said cover supported by said handle at said proximate end, said cover having an elongate section defining an interior space and an axis, at least a portion of said light generating portion of said lamp disposed within said interior space, said cover comprising a light transmissive material whereby light is transmittable from said interior space to outside said cover, said cover having a closed distal end located opposite said open proximate end;

a proximal restraining element comprising an integral portion of one piece with said cover, said proximal restraining element disposed near said proximal end of said cover, said proximal restraining element having a restraining surface oriented at an angle to said axis and engageable with said base portion whereby said restraining surface biases said base portion into axial engagement with said socket.

31. The work light of claim 30 wherein said restraining element has a second restraining surface oriented substantially parallel to said axis whereby said second restraining surface restricts lateral movement of said lamp.

32. The work light of claim 30 wherein said cover further comprises a distal restraining element comprising an integral portion of one piece with said cover, said distal restraining element disposed near said distal end of said cover, said distal restraining element having a second restraining surface, said second restraining surface disposed near said light emitting portion whereby said light emitting portion engages said second restraining surface after limited lateral movement.

33. The work light of claim 30 wherein said proximal restraining element rotationally engages said lamp, said cover threadingly engageable with said handle and said socket is rotatably supported within said handle.

34. The work light of claim 30 wherein said cover has a distal end section extending distally from a point proximate a distal end of said lamp and terminating in a distal end cap integrally formed with said cover, said distal end section consisting essentially of transparent material.

* * * * *